US012114797B2

(12) United States Patent
Park

(10) Patent No.: US 12,114,797 B2
(45) Date of Patent: Oct. 15, 2024

(54) CURTAIN ROD FIXING DEVICE

(71) Applicant: kamdanam Co., Ltd., Incheon (KR)

(72) Inventor: Seongwook Park, Incheon (KR)

( * ) Notice: Subject to any disclaimer, the term of this patent is extended or adjusted under 35 U.S.C. 154(b) by 0 days.

(21) Appl. No.: 18/126,394

(22) Filed: Mar. 25, 2023

(65) Prior Publication Data

US 2024/0115065 A1 Apr. 11, 2024

(30) Foreign Application Priority Data

Oct. 11, 2022 (KR) ..... 10-2022-0129706

(51) Int. Cl.
*A47H 1/142* (2006.01)
*A47H 1/122* (2006.01)

(52) U.S. Cl.
CPC ..... *A47H 1/142* (2013.01); *A47H 1/122* (2013.01)

(58) Field of Classification Search
CPC ..... A47H 1/142; A47H 1/122
See application file for complete search history.

(56) References Cited

U.S. PATENT DOCUMENTS 209,325 A 10/1878 Bright
443,175 A 12/1890 Gilbert
744,691 A 11/1903 Porter
1,995,370 A * 3/1935 Walters ..... F16B 5/0685 248/68.1
2,974,918 A * 3/1961 Voigtlander ..... A47B 57/46 248/220.42
4,707,906 A * 11/1987 Posey ..... F16L 3/223 24/339
9,872,580 B1 * 1/2018 Roddy ..... E06B 9/323
10,376,086 B1 * 8/2019 Mustafa ..... A47H 1/122
10,501,929 B2 * 12/2019 Henry ..... E04B 1/2604
11,185,185 B2 * 11/2021 Klowan ..... A47H 1/122
(Continued)

FOREIGN PATENT DOCUMENTS

JP H5-72280 U 10/1993
JP H1052360 A 2/1998
(Continued)

OTHER PUBLICATIONS

English Specification of 10-1829444.
(Continued)

*Primary Examiner* — Anita M King
(74) *Attorney, Agent, or Firm* — ANTONIO HA & U.S. PATENT, LLC

(57) ABSTRACT

The present disclosure relates to a curtain rod fixing device, comprising: a device body unit detachably installed and fixed to an installation part coupled to a curtain box or window frame; and a curtain rod supporting unit detachably coupled to at least two or more regions of the circumferential surface of the device body unit and provided with a curtain rod holder at an end thereof to support the curtain rod. The curtain rod holder is bent in multi-step and has elasticity so that curtain rods of various diameters can be mounted. This configuration allows the curtain rod to be easily and conveniently installed according to the position or shape of the curtain box or window frame where the curtain is installed, thereby having an effect of significantly reducing cost or operational loss.

6 Claims, 12 Drawing Sheets

(56) References Cited

U.S. PATENT DOCUMENTS

| | | | | |
|---|---|---|---|---|
| 2004/0129846 | A1* | 7/2004 | Adams | F21V 21/088 248/301 |
| 2011/0036963 | A1* | 2/2011 | Castellanos | A47B 96/06 248/304 |
| 2014/0231606 | A1* | 8/2014 | Sobb | A47F 5/0823 248/224.8 |
| 2018/0344067 | A1 | 12/2018 | Hornick, III | |

FOREIGN PATENT DOCUMENTS

| | | | |
|---|---|---|---|
| JP | 3211394 | U | 2/2022 |
| KR | 20-2009-0008358 | | 8/2009 |
| KR | 10-1829444 | | 2/2018 |
| KR | 20-2018-0002269 | | 7/2018 |
| KR | 30-1088740 | | 12/2020 |
| KR | 10-2022-0117585 | | 8/2022 |
| KR | 102503649 | B1 * | 2/2023 |

OTHER PUBLICATIONS

English Specification of 10-2022-0117585.
English Specification of 20-2009-0008358.
English Specification of 20-2018-0002269.
English Specification of 30-1088740.
English Specification of JPH5-72280U.
English Specification of JP3211394U.
English Specification of JPH1052360A.

* cited by examiner (a)

(b)

(a)

(b)

CURTAIN ROD FIXING DEVICE

CROSS-REFERENCE TO RELATED APPLICATION

This application claims priority to Korean Patent Application No. 10-2022-0129706 filed in the Korean Intellectual Property Office on Oct. 11, 2022, the disclosure of which is incorporated by reference herein in its entirety.

TECHNICAL FIELD

The present disclosure relates to a curtain rod fixing device, and more particularly, to a curtain rod fixing device that can be easily and simply installed according to the position or shape of a curtain box or window frame where curtains are installed, thereby significantly reducing cost or work loss.

DISCUSSION OF RELATED ART

As a means of blocking light on the window, a curtain 4 is installed as shown in FIG. 1. The curtain 4 is movably installed on the curtain rod 3 via the curtain ring 2. For the installation of the curtain rod 3, a device commonly called a curtain rod fixing device 1 is installed on the ceiling. That is, after fixing the curtain rod fixing device 1 to the ceiling, the curtain rod 3, in which the curtain ring 2 is movably inserted along the outer circumferential surface, is coupled to the curtain rod fixing 1 to be supported and then the curtain 4 is connected to the curtain ring 2 to complete the installation of the curtain 4.

When the installed curtain 4 is moved left and right, the curtain ring 2, which is coupled to the curtain 4 and forms one body with the curtain 4, moves left and right along the curtain rod 3 to cover or open the window.

Meanwhile, in order to install the curtain 4 as described above, first, the curtain rod fixing device 1 must be installed on the ceiling.

FIG. 1 schematically shows a curtain rod fixing device 1. For example, the curtain rod fixing 1 may have a structure as shown in FIG. 2. That is, the curtain rod fixing 1 according to the prior art is integrally formed with the fixing part 10 fixed to the wall or ceiling and the connection part 20 connected to the fixing part 10, and may include a ring 30 on which the curtain rod 3 is seated (See FIG. 1).

Further, a fastening hole 31 for fastening the screw S is formed on the outer surface of the ring 30. The screw S fastened to the fastening hole 31 presses the outer circumferential surface of the curtain rod 3 seated on the ring 30 to hold the curtain rod 3 so that it does not move.

The structure shown in FIGS. 1 and 2 is an extremely general structure. The curtain rod fixture 1, according to the prior art needs to fasten the curtain rod 3 seated on the ring 30 with a screw S, so the work is inevitably cumbersome. In particular, in the curtain rod fixing device 1, according to the prior art, the position at which the curtain rod 3 is installed is predetermined in one direction, so the curtain rod fixing device should be individually prepared according to the position or shape of the curtain box or window frame. Therefore, many losses occur in terms of cost or work. Considering these points, there is a need for a new type of curtain rod fixing device.

SUMMARY

An object of the present disclosure is to provide a curtain rod fixing device that can easily and conveniently install a curtain rod according to the position or shape of a curtain box or window frame in which curtains are installed, thereby significantly reducing cost or operational loss.

The curtain rod fixing device may comprise: a device body unit detachably installed and fixed to an installation part coupled to a curtain box or window frame; and a curtain rod supporting unit detachably coupled to at least two or more regions of the circumferential surface of the device body unit and provided with a curtain rod holder at an end thereof to support the curtain rod, wherein the curtain rod holder may be bent in multi-step and has elasticity so that curtain rods of various diameters may be mounted.

The curtain rod holder may have a first bending piece formed to have an arc shape on the inside of the bent portion and a second bending piece formed on the outside to have a larger diameter than the first bending piece.

The device body unit may comprise: a unit box having a parts receiving space therein; a plurality of sliding coupling rails provided on the circumferential surface of the unit box and to which the curtain rod supporting unit is selectively and slidingly coupled, a box fixing part provided inside or outside the unit box and fixing the unit box to the installation part, and a detachable box cover detachably coupled to a lower surface of the unit box and shielding the parts receiving space from the outside.

The box fixing part may comprise: a fixing latch having a threaded hole and provided with a base disposed in the parts receiving space, a bent plate part bent from the base and disposed over the inside and outside of the unit box, and a fixed plate part disposed parallel to the base at the end of the bent plate part and fixed to the installation part together with the support surface of the unit box; and a threaded bolt provided with a shaft passing through a through hole formed in a detachable box cover coupled to the lower end of the unit box and disposed in the parts receiving space, an end of which is rotatably coupled to the threaded hole of the fixing latch, and a handle head coupled to the shaft and disposed outside the unit box to rotate the shaft in a forward and reverse direction.

The curtain rod holder may be formed with a connection groove integrally coupled to the inside of the first and second bending pieces.

A wire may be coupled to the connection groove of the curtain rod holder so that both ends are coupled.

According to the curtain rod fixing device according to the present disclosure, the curtain rod can be easily and conveniently installed according to the position or shape of the curtain box or window frame in which the curtain is installed, thereby significantly reducing cost or work loss.

Further, it is possible to obtain the effect of fixing curtain rods of various diameters through the curtain rod holder formed in multiple stages.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF EXEMPLARY EMBODIMENTS

Advantages and features of the present disclosure, and methods of achieving the same become clear with reference to the embodiments described below in detail in conjunction with the accompanying drawings.

However, the present disclosure is not limited to the embodiments disclosed below and may be implemented in various different forms. Only the present embodiments make the disclosure of the present disclosure complete and are provided to fully inform the scope of the disclosure to those skilled in the art to which the present disclosure belongs. The present disclosure is only defined by the scope of the claims. Like reference numbers designate like elements throughout the specification.

Hereinafter, the present disclosure will be described with reference to drawings for explaining a curtain rod fixing device according to embodiments of the present disclosure.

Figure 3:
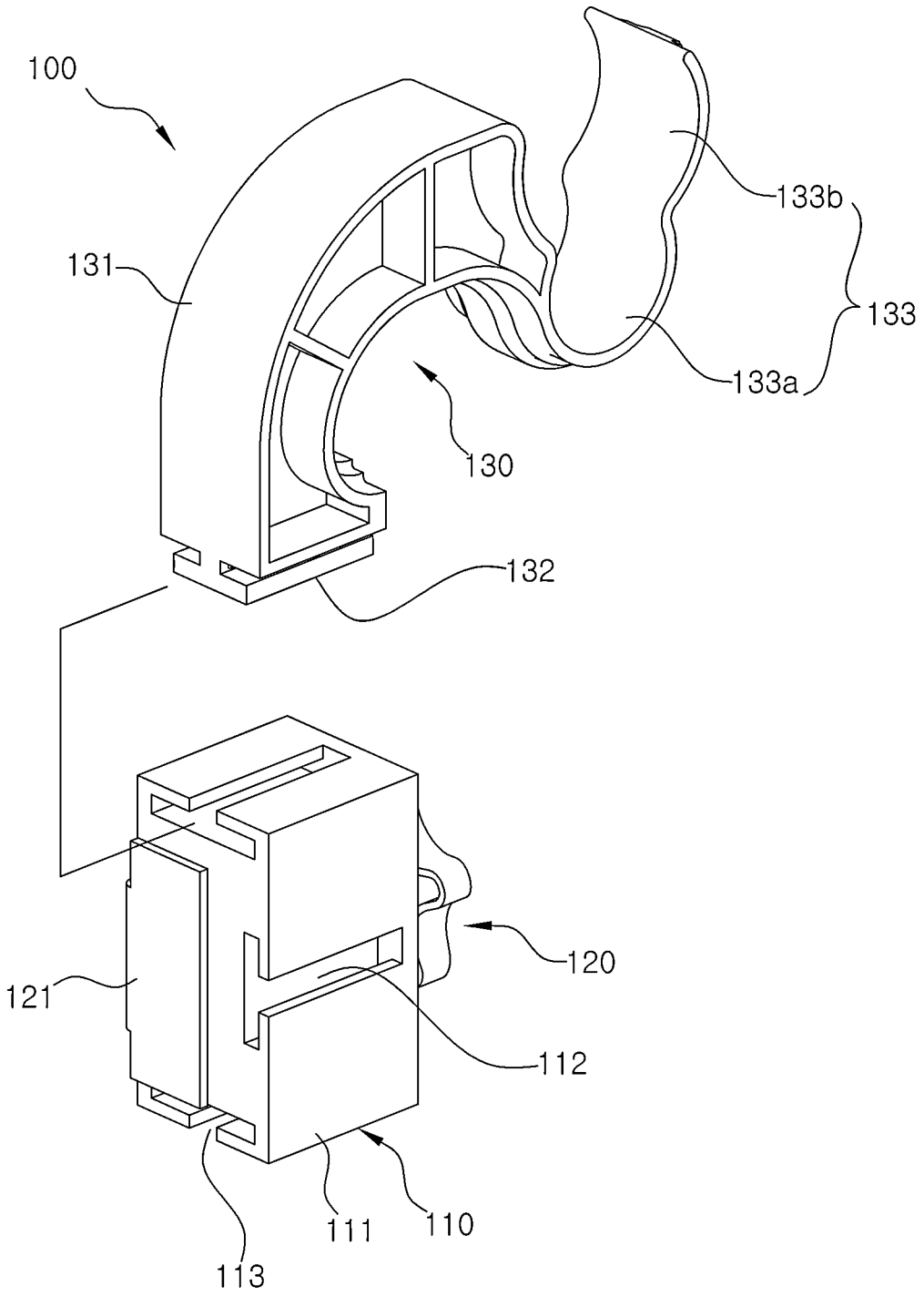
FIG. 3 is an exploded perspective view of a curtain rod fixing device according to a preferred embodiment of the present disclosure.
Figure 4:
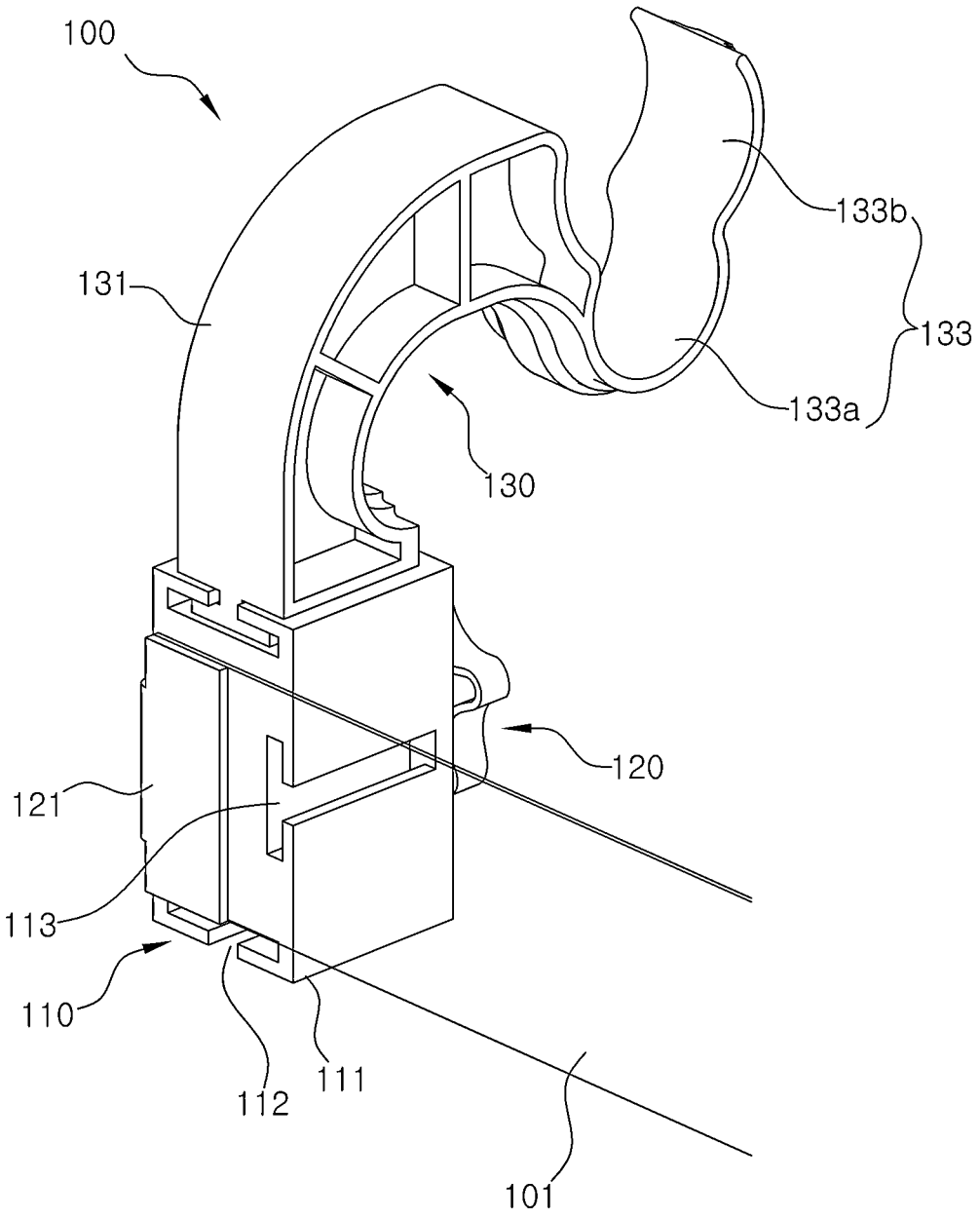
FIGS. 4, 5, and 6 are various examples of coupling between a device body unit and a curtain rod supporting unit according to a preferred embodiment of the present disclosure.
Figure 5:
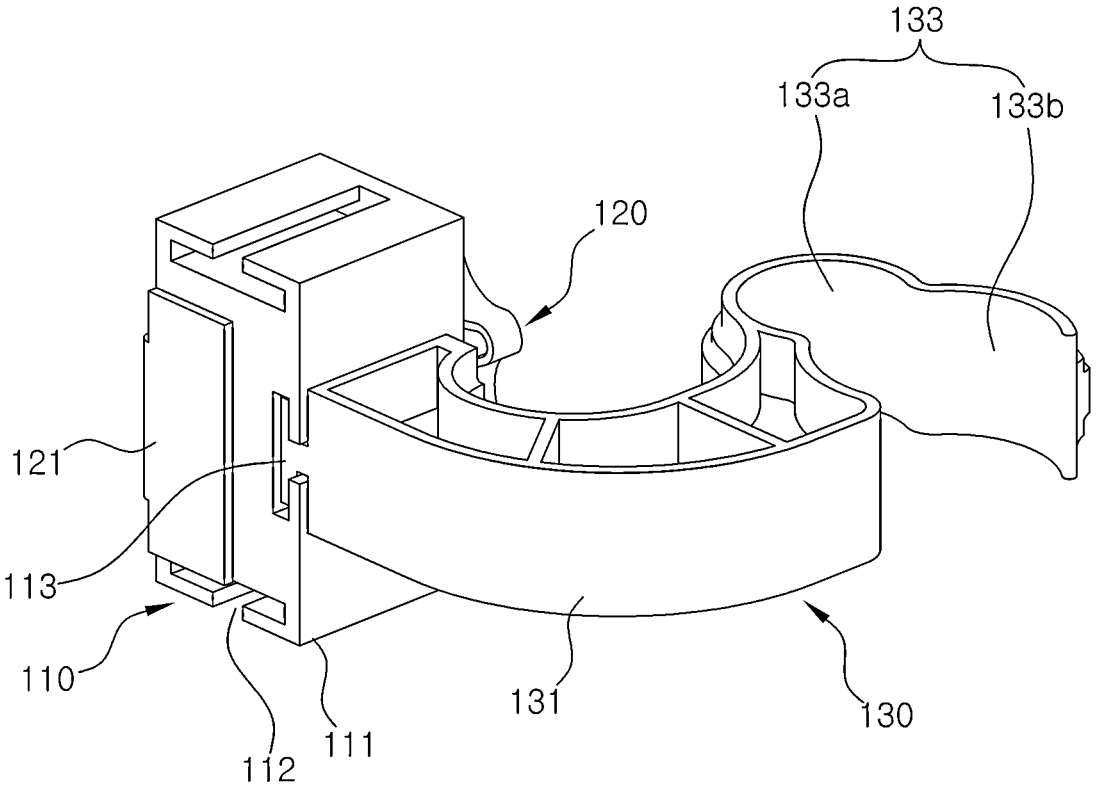
Figure 6:
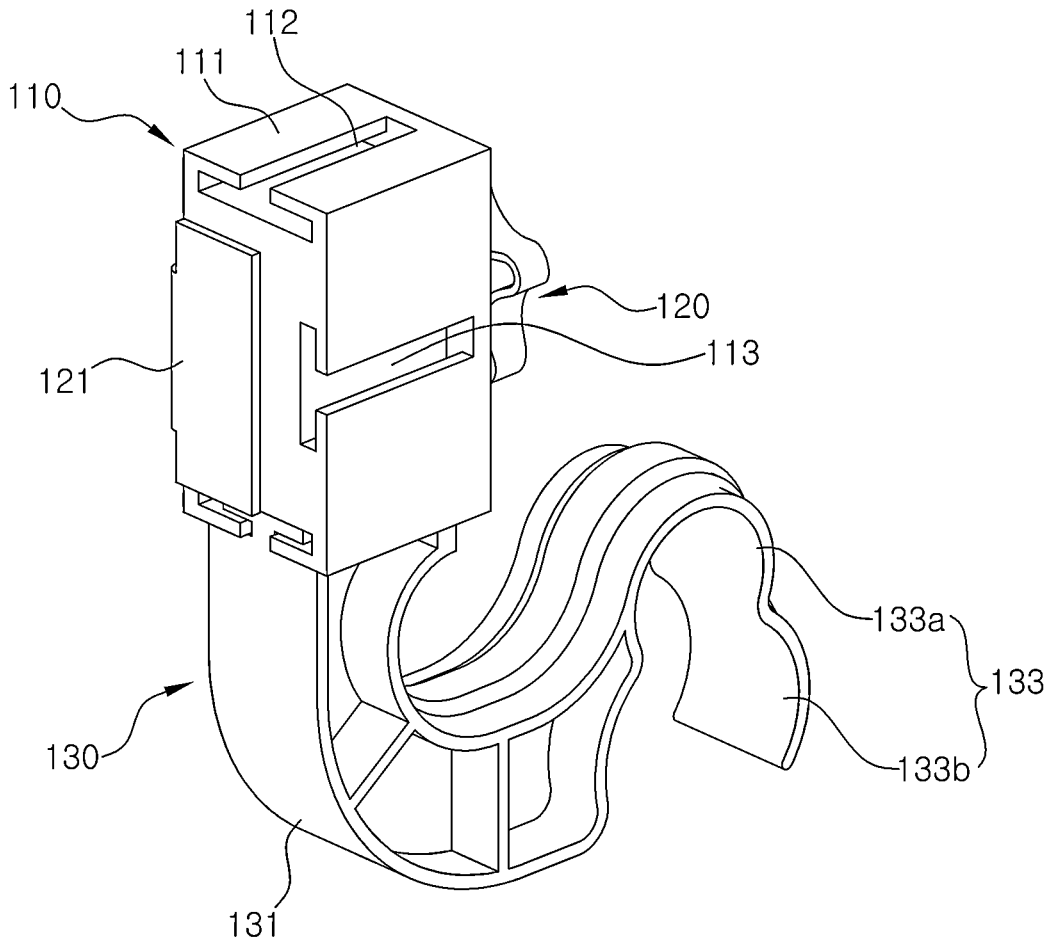
Figure 7:
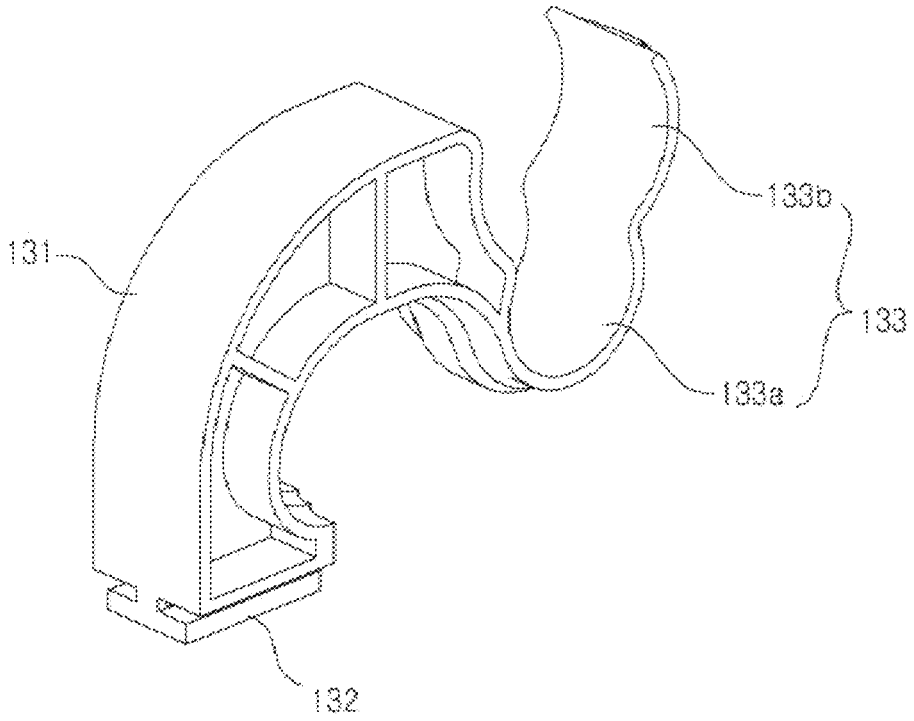
FIG. 7 is a perspective view of a curtain rod supporting unit according to a preferred embodiment of the present disclosure.
Figure 8:
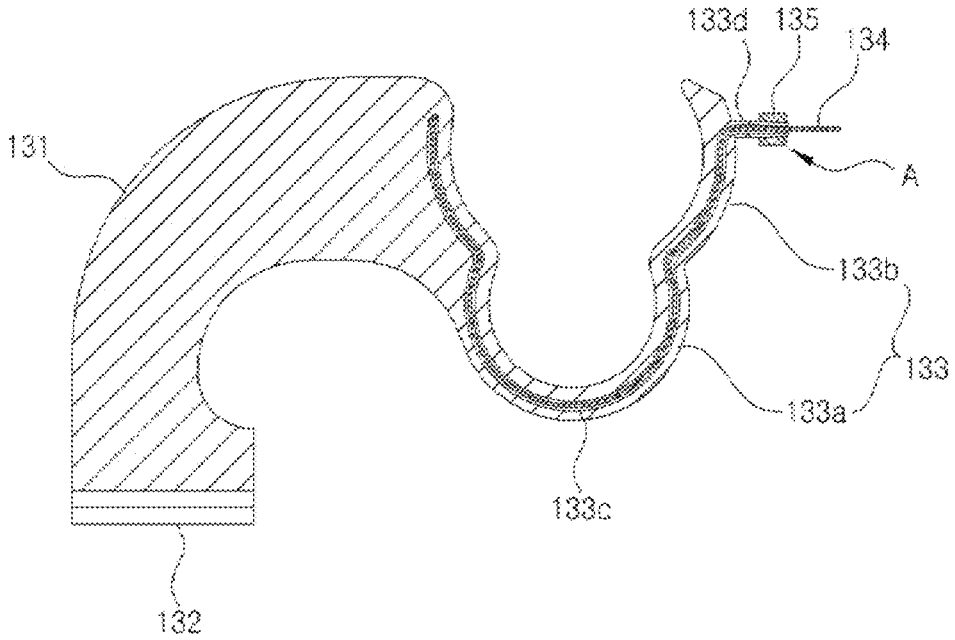
FIG. 8 is a cross-sectional view of FIG. 7 according to a preferred embodiment of the present disclosure.
Figure 9:
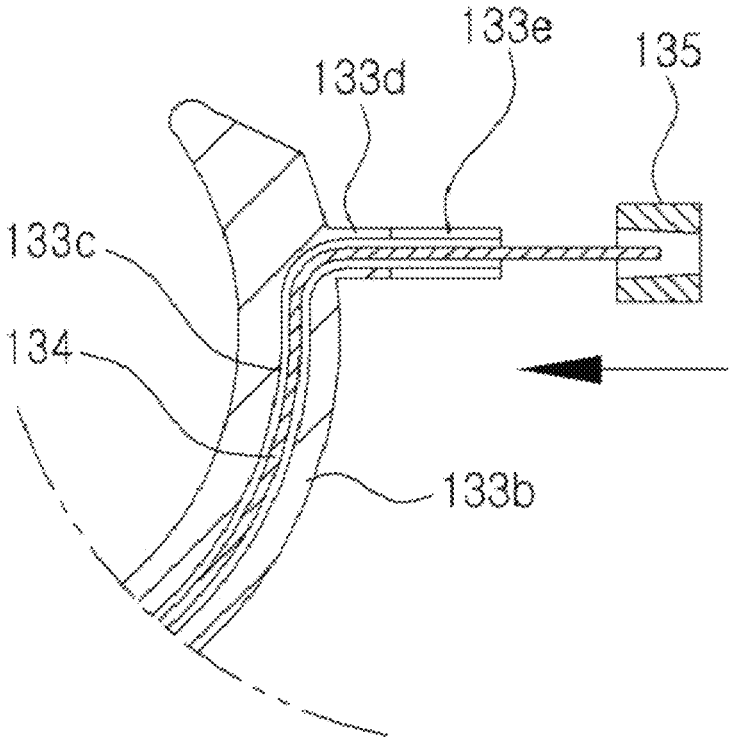
FIG. 9 is an enlarged view of "A" shown in FIG. 8 according to a preferred embodiment of the present disclosure.
Figure 10:
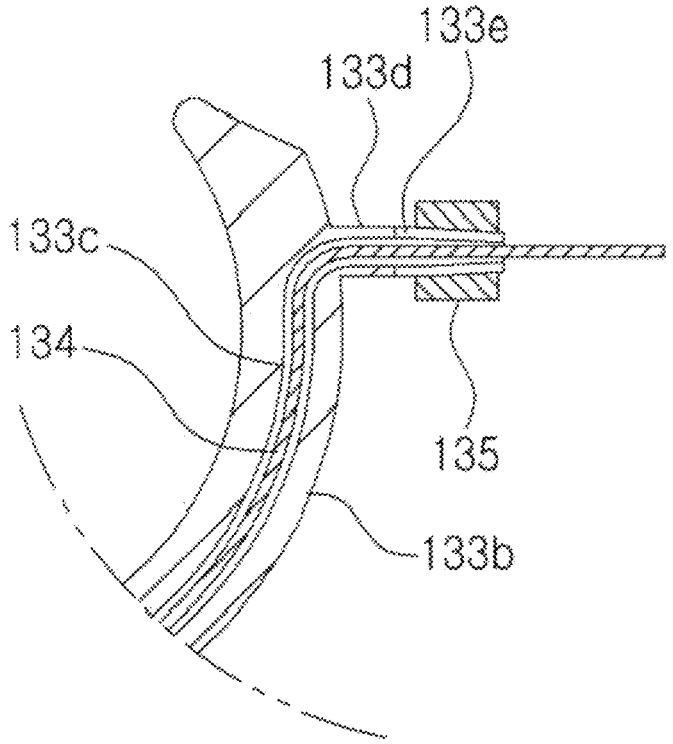
FIG. 10 is an exploded view of a tension adjusting device according to a preferred embodiment of the present disclosure.
Figure 11:
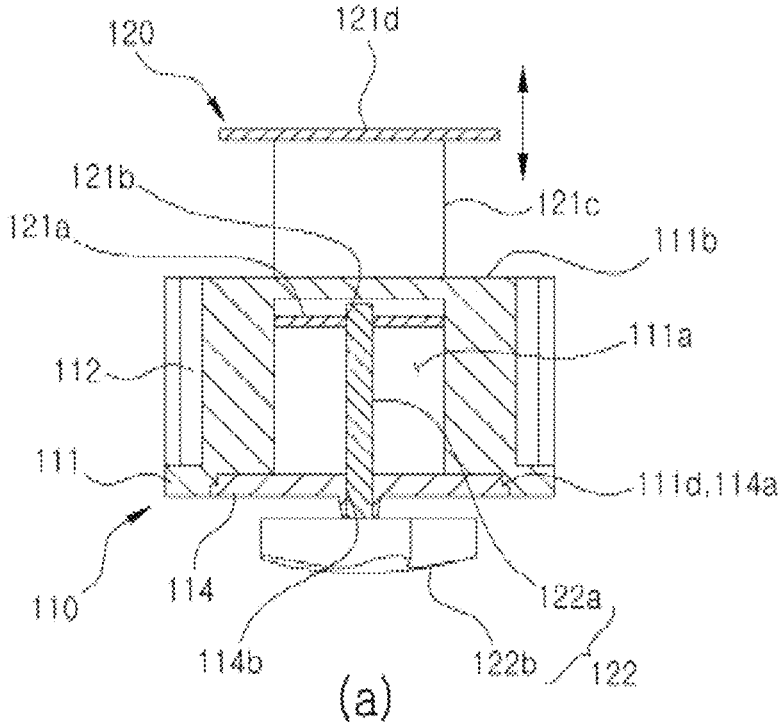
FIGS. 11 and 12 are operation diagrams of a box fixing part according to a preferred embodiment of the present disclosure.
Figure 11:
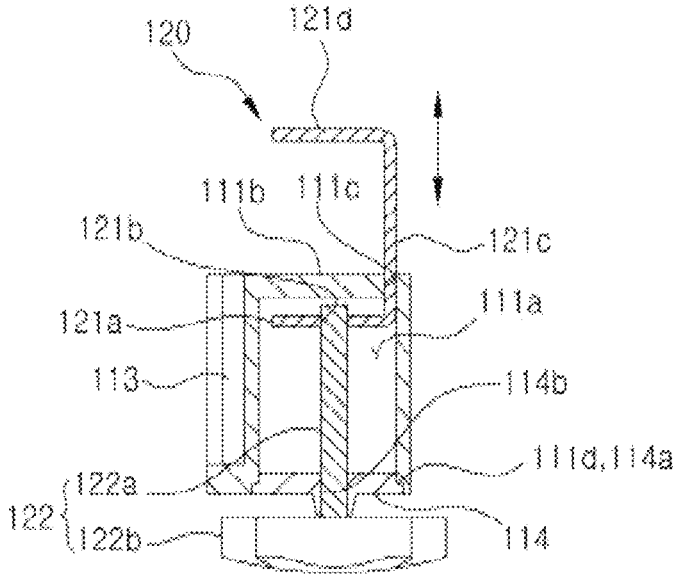
Figure 12:
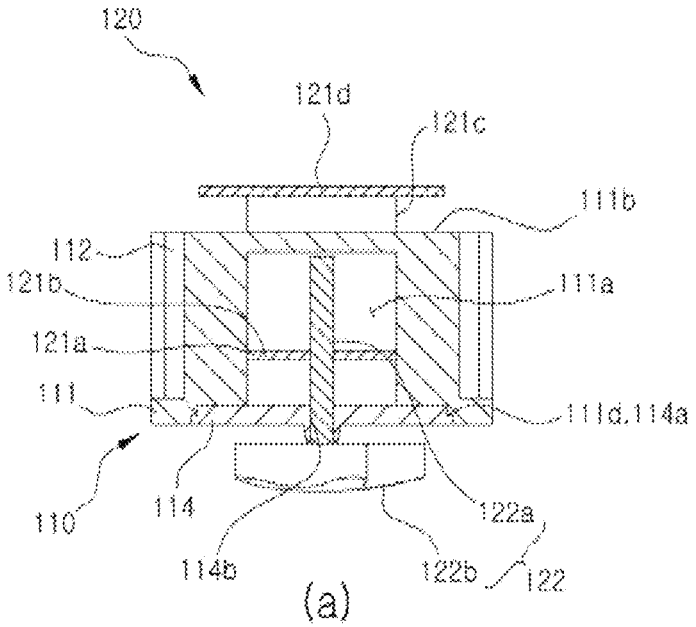
Figure 12:
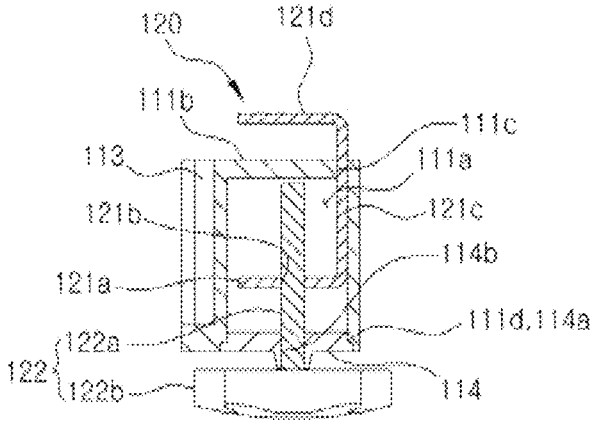

FIG. 3 is an exploded perspective view of a curtain rod fixing device according to a preferred embodiment of the present disclosure, FIGS. 4, 5, and 6 are various examples of coupling between a device body unit and a curtain rod supporting unit according to a preferred embodiment of the present disclosure, FIG. 7 is a perspective view of a curtain rod supporting unit according to a preferred embodiment of the present disclosure, FIG. 8 is a cross-sectional view of FIG. 7 according to a preferred embodiment of the present disclosure, FIG. 9 is an enlarged view of "A" shown in FIG. 8 according to a preferred embodiment of the present disclosure, FIG. 10 is an exploded view of a tension adjusting device according to a preferred embodiment of the present disclosure, and FIGS. 11 and 12 are operation diagrams of a box fixing part according to a preferred embodiment of the present disclosure.

Referring to these drawings, the curtain rod fixing device, according to the present embodiment, may easily and simply install the curtain rod according to the position or shape of the curtain box or window frame in which the curtain is installed, thereby significantly reducing cost or work loss.

Figure 1:
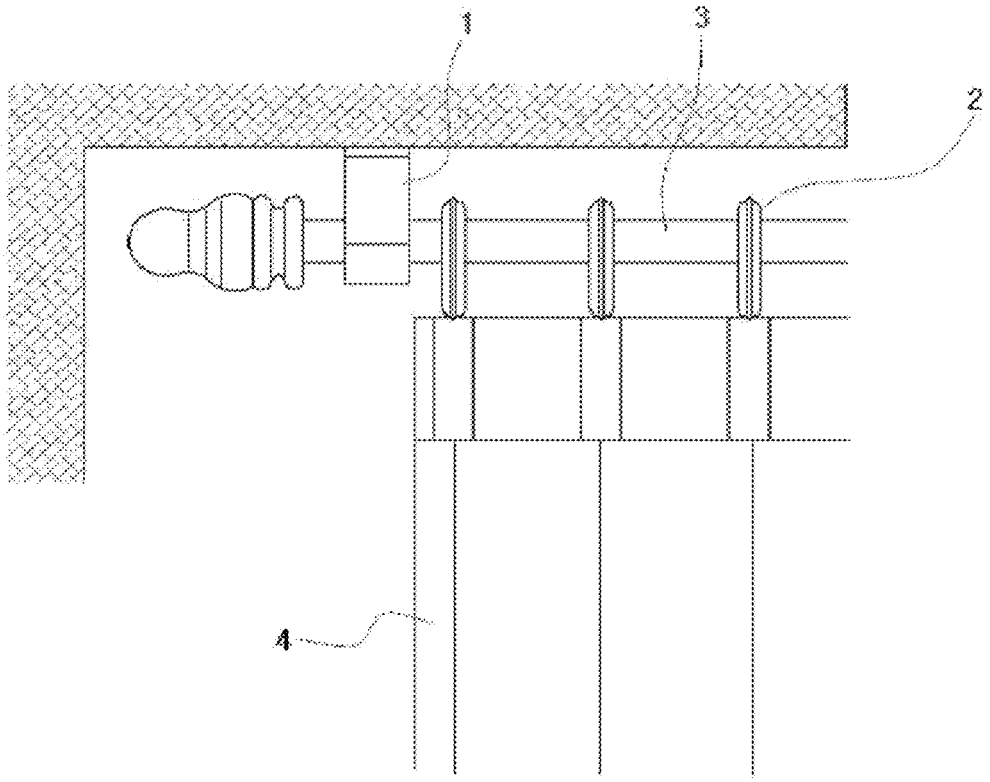
FIG. 1 PRIOR ART
FIG. 1 is a conventional curtain installation structure.
Figure 2:
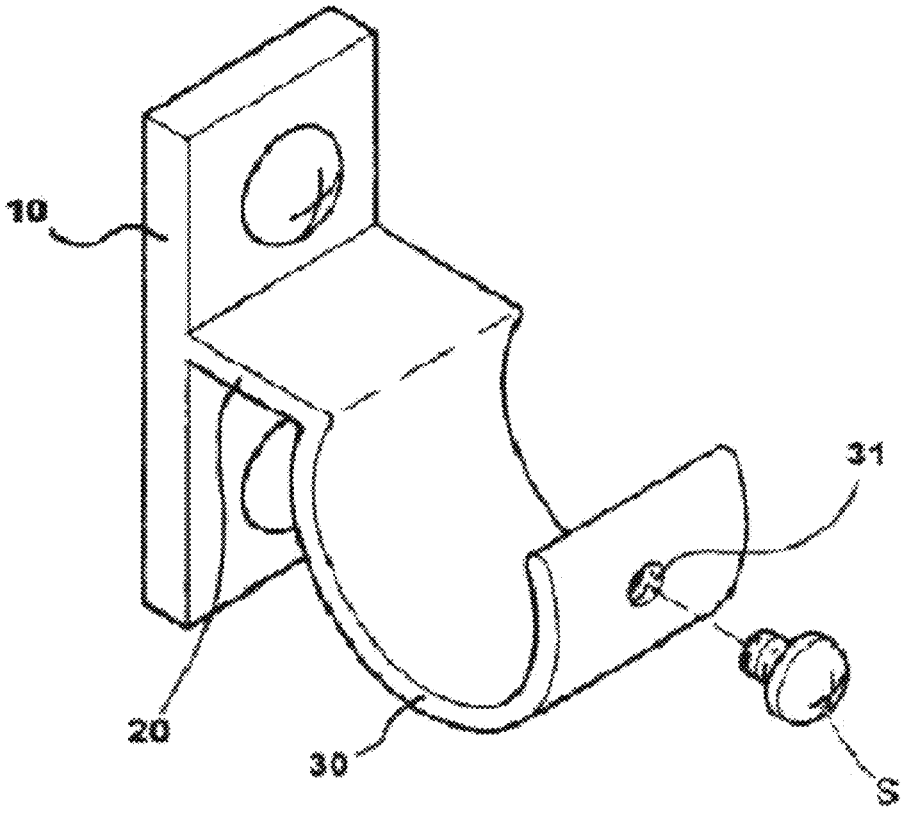
FIG. 2 PRIOR ART
FIG. 2 is a perspective view of the curtain rod fixing device shown in FIG. 1.

The curtain rod fixing device 100, according to the present embodiment, capable of providing such an effect comprises a device body unit 110 and a curtain rod supporting part 130, which are largely two parts. The curtain rod supporting part 130 has a structure coupled to the device body unit 110 in various directions, as shown in FIGS. 4, 5, and 6. In this case, the curtain rod (See reference number 3 of FIG. 1) may be easily and conveniently installed according to the position or shape of the curtain box or window frame where the curtain is installed.

Referring first to the device body unit 110, the device body unit 110 is a structure that is detachably installed on the installation part 101 provided on a curtain box or window frame so that the position is fixed. As schematically shown in FIG. 4, the installation unit 101 may refer to a plate body having a certain thickness, such as a window frame or a frame.

The device body unit 110 is coupled and fixed to the installation part 101, the curtain rod supporting unit 130 is coupled to the device body unit 110, and then the curtain rod (reference number 3 of FIG. 1) is installed, thereby easily installing a curtain (not shown).

The device body unit 110 comprise: a unit box 111 with parts receiving space 111*a* so that the lower part is opened on the inside with reference to FIG. 11, a plurality of sliding coupling rails 112 and 113 provided on the circumferential surface of the unit box 111 and to which the curtain rod supporting unit 130 is selectively and slidingly coupled, a box fixing part 120 provided inside or outside the unit box 111 and fixing the unit box 111 to the installation part 101, and a detachable box cover 114 detachably coupled to a lower surface of the unit box 111 and shielding the parts receiving space 111*a* from the outside. An opening 111*c* is formed at the upper end of the unit box 111 to be coupled to the parts receiving space, and a step 111*d* is formed along the circumference of the open portion at the lower end. A stopping part 114*a* is formed in the detachable box cover 114 to be caught and fixed to the step 111*d* when coupled to the lower surface of the unit box 111.

A through hole 114*b* is formed in the detachable box cover 114.

The unit box 111 is an exterior structure of the device body unit 110 and forms a place where the box fixing part 120 is mounted. The unit box 111 may be manufactured in the form of a square box with an empty inside, but other forms are also possible. Therefore, the scope of the present disclosure is not limited to the shape of the drawings.

As described above, the sliding coupling rail parts 112 and 113 are provided on the circumferential surface of the unit box 111 and form a place where the curtain rod supporting unit 130 is selectively and slidably coupled.

This embodiment provides a plurality of sliding coupling rail parts 112 and 113. The plurality of sliding coupling rail parts 112 and 113 comprise the first sliding coupling rail part 112 provided on both sides of the unit box 111, and the second sliding coupling rail part 113 provided on one side of the unit box 111. The box fixing part 120 serves to fix the unit box 111 to the installation part 101. The box fixing part 120 may include a fixing latch 121 and a threaded bolt 122.

The fixing latch 121 has the threaded hole 121*b* and is provided with the base 121*a* disposed in the parts receiving space 111*a*, the bent plate part 121*c* bent from the base 121 and disposed over the inside and outside of the unit box 111, and the fixed plate part disposed parallel to the base 121*a* at the end of the bent plate part 121*c* and fixed to the installation part together with the support surface 111*b* of the unit box 111. The fixing latch 121 may be an integral structure made of a metal material with rigidity.

The threaded bolt 122 provided with the shaft 122*a* passing through a through hole 114*b* formed in a detachable box cover 114 coupled to the lower end of the unit box 111 and disposed in the parts receiving space 111*a*, an end of which is rotatably coupled to the threaded hole 121*b* of the fixing latch 121, and the handle head 122*b* coupled to the shaft 122*a* and disposed outside the unit box 111 to rotate the shaft 122*a* in a forward and reverse direction.

While the user places, with this structure, the device main unit 110 so that the installation part 101 is disposed between the support surface 111*b* of the unit box 111 and the fixed plate part 121*d* of the fixing latch 121, the device body unit 110 may be fixed in position by tightening the threaded bolt 122 while rotating the handle head 122*b* of the threaded bolt 122.

As described above, the detachable box cover 114 is detachably coupled to the lower surface of the unit box 111 and serves to shield the parts accommodating space 111*a* from the outside.

Meanwhile, the curtain rod supporting unit 130 supports the curtain rod (See reference number 3 of FIG. 1) on which the curtain is installed, but it is a structure that is selectively and detachably coupled to at least two or more regions of the circumferential surface of the device main unit 110.

In other words, the curtain rod supporting unit 130 has a structure coupled in various directions with respect to the device body unit 110 as shown in FIGS. 4, 5 and 6. In this case, the curtain rod (See reference number 3 of FIG. 1) can be easily and conveniently installed according to the position or shape of the curtain box or window frame where the curtain is installed.

The curtain rod supporting unit 130 includes the unit body 131, the sliding block 132 provided on one side of the unit body 131 and selectively slidingly coupled to the first and second sliding coupling rail parts 112 and 113, and the curtain rod holder 133.

There is an advantage in that the curtain rod supporting unit 130 may be easily coupled to the device body unit 110 in various directions through the sliding block 132.

The curtain rod holder 133 forms the other side of the unit body 131, but forms a place where the curtain rod 3 (See FIG. 1) is actually mounted.

The curtain rod holder 133 has an arc shape, so the curtain rod 3 (See FIG. 1) may enter and exit. The curtain rod holder 133 is formed in multi-step so that the bent portion may hold curtain rods of various sizes to have an arc shape. A first bending piece 133*a* having a predetermined diameter, is formed on the inside of the arc-shaped portion of the curtain rod holder 133, and a second bending piece 133*b* is formed outside the arc-shaped portion and integrally extending from the first bending piece 133*a* and having a diameter greater than the diameter of the first bending piece 133*a*. The multi-step arc shape may be formed in three or more multi-step, as well as the first beading piece 133*a* and the second bending piece 133*b*. Therefore, curtain rods of various sizes may be mounted by the multi-step arc shape.

The curtain rod holder 133 is formed of a metal or synthetic resin material having a certain strength to support the curtain rod, and the first bending piece 133*a* and the second bending piece 133*b* have elasticity so that curtain rods of various sizes may be mounted. The connection groove 133*c* is integrally formed on the first bending piece 133*a* and the second bending piece 133*b* along the longitudinal direction inside the curtain rod holder. The connection groove 133*c* extends to the end of the curtain rod holder 133. The connection groove 133*c* is formed inside the curtain rod holder 133 to form elasticity, and the elasticity is excellent simultaneously. A fixed port 133*d* connected to the connection groove 133*c* and protruding outward is formed at the end of the curtain rod holder 133. A screw thread is formed on the outer circumferential surface of the fixed port 133*d*, and a cutout 133*e* is formed at regular intervals along the circumference of the fixed port 133*d*.

A tension control wire 134 is connected to the inside of the connection groove 133*c*. One end of the tension control wire is connected to the inside of the connection groove, and the other extends to the outside through the fixed port 133*d*.

A tension adjustor 135 for adjusting the length of the tension control wire 134 is fastened to the fixed port 133*d*. The tension adjustor 135 has a ring shape and an inner diameter equal to the outer diameter of the fixed port but has a tapered shape so that the diameter decreases from one side to the other.

When the tension adjustor is fastened to the fixed port, the end of the fixed port is pressed through the tapered shape according to the tightening strength so that the end of the fixed port is pushed inward by the cutout, and the tension control wire is pressurized and fixed by the fixing port pushed inward. Therefore, the length (tension) of the tension control wire is adjusted through the tension adjustor, and thus the elastic force of the curtain rod holder is adjusted.

There is an advantage that the curtain rod holder 133 has such an effective structure to be commonly used for a general curtain rod (See reference number 3 of FIG. 1) or a smaller curtain rod (not shown).

According to the present embodiment, which acts as a structure as described above, the curtain rod (See the reference number 3 of FIG. 1) can be easily and conveniently installed according to the position or shape of the curtain box or window frame where the curtain is installed, thereby significantly reducing cost or work loss.

According to the curtain rod fixing device, according to the present disclosure, the curtain rod can be easily and conveniently installed according to the position or shape of the curtain box or window frame in which the curtain is installed, thereby significantly reducing cost or work loss.

Further, it is possible to obtain the effect of fixing curtain rods of various diameters through the curtain rod holder formed in multi-step.

Those skilled in the art to which the present disclosure pertains will understand that the present disclosure can be embodied in other specific forms without changing its technical spirit or essential features. Therefore, the embodiments described above should be understood as illustrative in all respects and not limiting. The scope of the present disclosure should be indicated by the claims to be described later rather than the detailed description above, and all changes or modifications derived from the meaning and scope of the claims and their equivalent concepts should be construed as being included in the scope of the present disclosure.

What is claimed is:

1. A curtain rod fixing device comprising:

a device body unit detachably installed and fixed to an installation part coupled to a curtain box or window frame; and a curtain rod supporting unit detachably coupled to at least two or more regions of the circumferential surface of the device body unit and provided with a curtain rod holder at an end thereof to support a curtain rod, wherein the curtain rod holder is bent in multi-step and has elasticity so that curtain rods of various diameters may be mounted.

2. The curtain rod fixing device of claim 1, wherein the curtain rod holder has a first bending piece formed to have an arc shape on the inside of the bent portion and a second bending piece formed on the outside to have a larger diameter than the first bending piece.

3. The curtain rod fixing device of claim 1, wherein the device body unit comprises:

a unit box having a parts receiving space therein;

a plurality of sliding coupling rails provided on the circumferential surface of the unit box and to which the curtain rod supporting unit is selectively and slidingly coupled a box fixing part provided inside or outside the unit box and fixing the unit box to the installation part; and a detachable box cover detachably coupled to a lower surface of the unit box and shielding the parts receiving space from the outside.

4. The curtain rod fixing device of claim 3, wherein the box fixing part comprises:

a fixing latch having a threaded hole and provided with a base disposed in the parts receiving space, a bent plate part bent from the base and disposed over the inside and outside of the unit box, and a fixed plate part disposed parallel to the base at an end of the bent plate part and fixed to the installation part together with the support surface of the unit box; and a threaded bolt provided with a shaft passing through a through hole formed in the detachable box cover coupled to the lower end of the unit box and disposed in the parts receiving space, an end of which is rotatably coupled to the threaded hole of the fixing latch, and a handle head coupled to the shaft and disposed outside the unit box to rotate the shaft in a forward and reverse direction.

5. The curtain rod fixing device of claim 2, wherein the curtain rod holder is formed with a connection groove integrally coupled to the inside of the first bending piece and the second bending piece.

6. The curtain rod fixing device of claim 5, wherein a wire is coupled to the connection groove of the curtain rod holder so that both ends are coupled.

* * * * *